US005478167A

United States Patent [19]

Oppenheimer et al.

[11] Patent Number: 5,478,167

[45] Date of Patent: Dec. 26, 1995

[54] BUOYANT MATTER DIVERTING SYSTEM

[76] Inventors: M. Leonard Oppenheimer, 8308 Marcie Dr., Pikesville, Md. 21208; Walter S. Saunders, 208 S. Pulaski St. 4H, Baltimore, Md. 21223

[21] Appl. No.: 770,116

[22] Filed: Oct. 2, 1991

[51] Int. Cl.[6] ..... E02B 3/02

[52] U.S. Cl. ..... 405/60; 405/15; 405/25; 405/80

[58] Field of Search ..... 405/15, 21, 25, 405/26, 27, 28, 30, 35, 52, 60, 61, 73, 74, 80, 118

[56] References Cited

U.S. PATENT DOCUMENTS

| | | | |
|---|---|---|---|
| 3,022,632 | 2/1962 | Parks | 405/26 |
| 3,830,066 | 8/1974 | Larsen | 405/25 |
| 3,892,075 | 7/1975 | Tibbett | 405/28 |
| 4,264,233 | 4/1981 | McCambridge | 405/26 |
| 4,560,304 | 12/1985 | Jenkins et al. | 405/74 |
| 4,661,013 | 4/1987 | Jenkins | 405/74 |
| 4,711,597 | 12/1987 | Odgaard et al. | 405/25 |

*Primary Examiner*—David H. Corbin
*Attorney, Agent, or Firm*—Max Stul Oppenheimer

[57] ABSTRACT

A streamwise-vortex generating diverter is placed upstream from a structure to protect the structure. The diverter is positioned to induce a vortex, or rotation, in the current flow whose axis is essentially parallel to the streamwise flow. This rotating flow persists downstream of the diverter effectively guiding debris away from the protected structure.

7 Claims, 5 Drawing Sheets

BUOYANT MATTER DIVERTING SYSTEM

BACKGROUND

FIELD

The instant invention relates to devices installed in a stream to protect downstream structures from damage by contaminants. The term stream is intended to include any fluid, whether normally flowing or flowing only by virtue of intermittent activity such as tidal activity or during flooding.

Downstream is defined as situated in or along a stream a distance from the devices of the instant invention in the direction of the flow. Upstream is defined similarly except that the direction is opposite that of the flow.

Contaminant is defined as any material, substance or object carried in or on a fluid other than the fluid itself.

Buoyant is defined to include the state of a contaminant where, by virtue of its displacement, it may be floating on the surface of the fluid, partly submerged, or completely submerged but not resting on the bed of a fluid channel.

Scour damage is defined as damage resulting from contaminants abrading a structure. Scour is also used in its dictionary definition, ie, to clear, dig, or remove by or as if by a powerful current or water.

Vortex-pair is defined as any pair of counter-rotating vortices generated by one or more vortex-generators.

PRIOR ART

Although the invention has utility in the general case of fluids, the primary focus of the prior art has been the protection of waterway structures from damage caused by debris impact. Prior art techniques function by increasing the structure's clearance above the normal water surface, the space between support members and by streamlining the support structures in an attempt to minimize the damage when impact does occur. Such impact results in damage to the structure necessitating expensive repair and restoration and may lead to total destruction or failure of the structure.

The prior art also teaches the use of debris arresters or deflectors, such as one or more vertical pilings, or bundles of pilings, driven into a river bed upstream of a bridge structure to divert ice, logs and other debris from impacting the structure.

Conventional barriers or pilings are of limited effectiveness because they set up a recirculating flow, the axis of which is disposed vertically. Our experimental work, including flow-visualization techniques, have shown such flow and that it can cause deflected debris to rotate. Further, the debris tends to be returned to its original course with the same potential of impacting the structure.

Moreover, vertically eddying flow may cause certain types of debris, such as broken branches to become entangled with the barrier thereby accumulating additional debris. When the expanded accumulation of debris breaks loose, its increased size presents a greater likelihood of impact with resultant greater damage than if there had been no barrier at all. The conventional barrier affects the stream flow primarily in the immediate region of its location. Thus, a rotary motion about a vertical axis is imparted to logs or other elongated-shaped debris. A rotating log is more likely to become wedged in or across the structure, causing damming, thus resulting in more severe damage than had the barrier not been installed.

Reference is made to U.S. Pat. No. 4,560,304, December 1985, Jenkins/Sparks and U.S. Pat. No. 4,661,013, April 1987, Jenkins. It should be noted that these inventions teach the use of vortex-generating devices situated close to the bottom of a waterway with the purpose of maintaining an agitated condition of the silt in order to minimize the settling thereof and allowing the stream current to carry it downstream. This is in contrast to our invention wherein the vortex generators are positioned to divert contaminants from a protected structure.

SUMMARY OF THE INVENTION

The present invention comprises a streamwise-vortex generating diverter placed upstream from a structure to protect it from contaminants. The novel diverter is positioned at a depth sufficiently below the surface to minimize the likelihood of undesirable contact with vehicles or debris. In this position it induces a vortex, or rotation, in the current flow whose axis is essentially parallel to the streamwise flow. This rotating flow persists downstream of the barrier effectively guiding debris away from the protected structure. Note that this is accomplished without supplying any power from outside sources. The absence of machinery and few, if any, moving parts results in a virtually maintenance-free installation.

OBJECTS

1. The principal object of the invention is to provide a streamwise-vortex generating diverter to significantly reduce the hazard of damage to downstream structures due to impact and abrasion from buoyant debris.

2. Another object is to reduce the maintenance required for such downstream structures.

3. Another object is to reduce the hazard of collision of water vehicles with such structures.

4. Another object is to control the formation of surface ice.

5. Another object is to provide a diverter which is not readily liable to impact from debris.

6. Another object is to provide such a diverter which automatically adjusts to changing conditions of flow.

BRIEF DESCRIPTION OF THE FIGURES

FIG.17 is an illustration of a hemilunate shape.

TECHNICAL DESCRIPTION

Although the invention has utility for fluids generally, it can be described with reference to the particular case of protecting a bridge.

Figure 1:
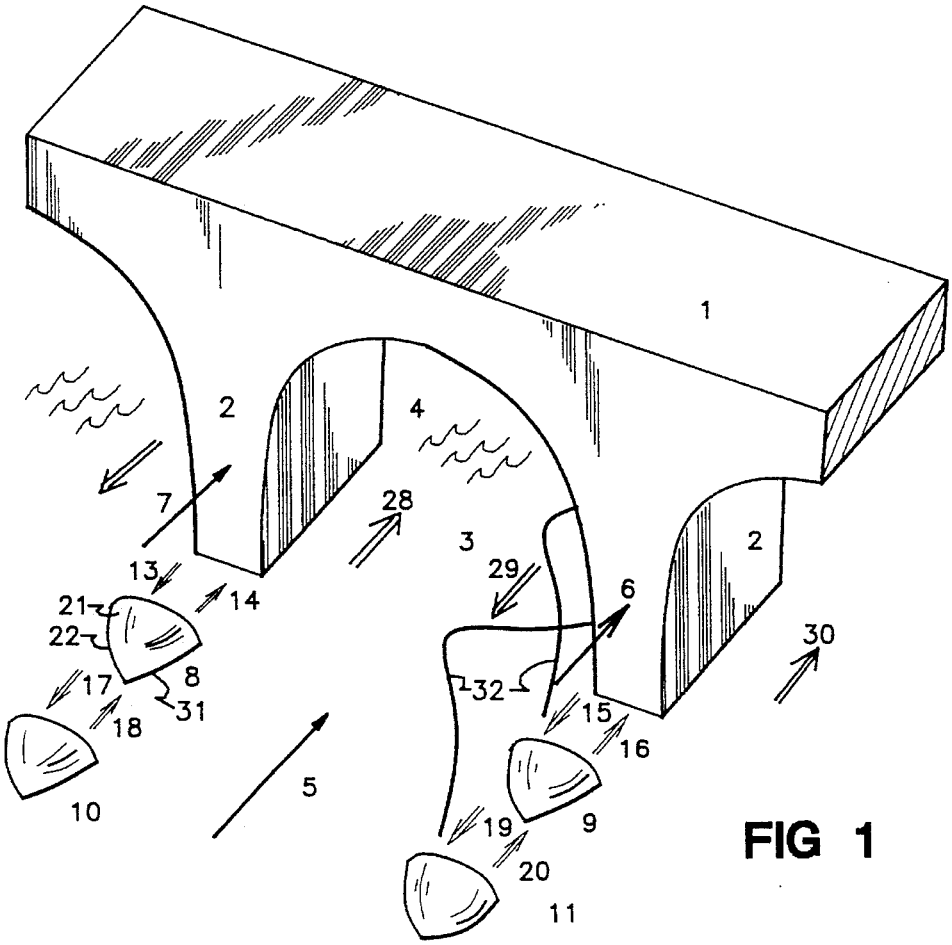
FIG. 1 is a perspective view of a bridge with the novel vortex-generating diverters shown diagrammatically upstream of the bridge structure.
Figure 2:
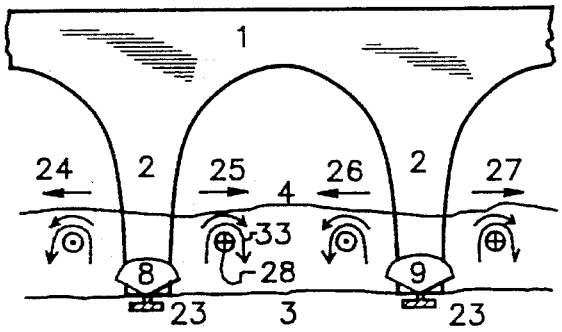
FIG. 2 is a front elevation of FIG. 1.
Figure 3:
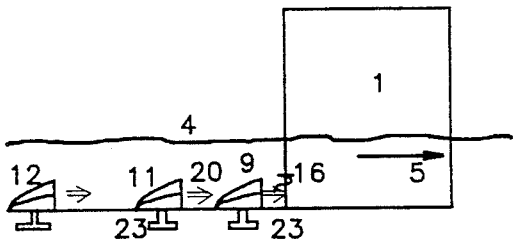
FIG. 3 is a right-side profile of FIG. 1.

FIGS. 1, 2 and 3 show perspective, front elevation, and right profile views of a bridge 1 supported by piers 2. The stream bed is indicated by 3 and the water surface by 4. The direction of water flow is indicated by arrow 5. Imaginary lines 6 & 7 are drawn from the centerline of each pier 2 in the upstream direction parallel to the direction of the water-flow 5. Buoyant debris approaching the bridge along lines 6 and 7 would ordinarily impact the piers 2 causing structural or scour damage.

The instant invention is illustrated by novel devices 8, 9, 10, 11 placed upstream of the bridge, and disposed more or less along lines 6 and 7. The devices 8 through 11 include hydrodynamically active surfaces which generate a rotation of the flowing fluid about an axis parallel to the direction of the stream flow, denoted by arrow 5. This rotation is designated streamwise vorticity. The sense of rotation is conveniently described by the Right-hand Rule: using the right hand with the thumb pointing downstream, rotation in the direction the fingers point is identified as positive vorticity and is denoted by a double arrow pointing downstream. Rotation in direction opposite that direction is identified as negative vorticity and the double arrow points upstream.

Using this convention the vorticity generated by the novel diverters 8 through 11 is denoted by double arrows 13 through 20. Vortex generator 8 has upper surface 21 which is inclined upwardly. Thus, fluid in contact with this surface is upwardly deflected. This results in negative vorticity shed from the edge 22 and rolling up into a streamwise vortex as denoted by arrow 13. The opposite edge of diverter 8 has edge 31 disposed rearwardly and upwardly as edge 22. However, edge 31 is disposed outwardly in the opposite sense to 22 so that the vorticity shed by edge 31 is positive as indicated by arrow 14. Similarly, diverters 9 through 12 generate similar pairs of streamwise vortices denoted by arrows 15 through 20.

B. Thwaites, on page 454 of "Incompressible Aerodynamics," Oxford, 1960, discusses the calculation of induced drag and the corresponding induced average swirl angle P in the Trefftz plane. Although the swirl angle may not be precisely calculated for the instant invention by the referenced calculation due to its deviation from the planar wing configuration, values determined empirically may be inserted in the referenced formulae and the swirl angle thereby determined. In the instant invention it is only necessary to apply these calculations to a vortex generator such as 9. Our experimental work has indicated that the preferred location of 9 is such that the average "downwash," as defined by Thwaites, is perpendicular to a radius drawn from the vortex core, indicated by arrow 14, as shown by 52 in FIG. 15.

The diverters 8 through 11 are shown as anchored by a bottom portion which is buried beneath the stream bed 3. Note that for the novel diverters to produce vorticity, it is not necessary for any portion of them to be near the surface of the water 4. Therefore, they may be positioned so that they do not present a hazard to navigation and are not normally liable to be impacted by debris themselves. The devices must simply be placed so as to generate a streamwise vortex which affects the flow of buoyant contaminants.

The operation of the vortex generators can now be understood. The generators produce streamwise vorticity in the flow which is most easily conceived of as an array of streamwise vortices. These vortices induce flow in relative motion with respect to the bridge piers 2. This relative motion, denoted by arrows 24, 25, 26 and 27, persists downstream, and throughout this region, debris is deflected from the path 6 or 7 which it would otherwise have followed. Thus, the debris may be guided away from impact with piers 2 and pass safely under the bridge near the center of its opening.

Considering the flow in more detail it can be seen that diverter 10 creates a vortex-pair 17 and 18. Streamwise vortex 17 deflects surface-borne debris in the direction of arrow 24 while on the other side of 10 the vortex 18 influences debris in the opposite direction 25. The vortices 17 and 18 by themselves can mitigate damage to a pier 2 along line 7. Their effect can be reinforced by another diverter 8, of the same general design, interposed along 7 between 10 and 2. Diverter 8 generates vorticity 13 and 14 as previously explained. Vorticity 13 enhances the effect of that denoted by 17 while 14 enhances the effect of 18.

It should be noted that it is possible for a single generator to cause a pair of vortices to be generated in such a manner as to leave a region of the surface uninfluenced by the vortices where debris may not be strongly diverted. This condition may be corrected by placing a,plurality of vortex generators, offset from each other with respect to the stream flow, along lines 6 and 7 or, alternatively, tether the vortex generators so as to allow a controlled amount of lateral oscillation.

Vortices of the same sign and in the same line, such as 13 and 17 or 14 and 18, have been observed to amalgamate into a single streamwise vortex. This is indicated schematically in FIGS. 1 and 2 by arrow 28.

Such vortices do not always amalgamate nor is it necessary for them to do so. They are often observed to follow a more or less helical path represented schematically by lines 32 in FIGS. 1 and 2. The effect on debris is the same; the debris is diverted to a region where impact is avoided.

Even when a stream has great depth compared to the distance between piers the vortex generators are still effective. Streamwise vortices 14 and 18 will migrate upward along path 33, FIG. 2, across surface 4 and in the direction of arrow 25, thence downward along the center-line between adjacent piers 2.

It is desirable but not essential that the vortex generators be deployed as transverse pairs 8, 9 and 10, 11. This is shown in FIG. 3 where line 7 employs an additional vortex-pair generator 12. This would be especially useful if, for example, the water were deeper at 6 than at 7 so that vorticity 29 needs to be stronger than 28 in order to balance flows 25 and 26, thus assuring the diversion of debris to the center of the span between adjacent piers 2.

Citing the example of a bridge span supported by a single central pier it may be protected by a single vortex generator or by a single line of such generators rather than pairs.

Pieces of floating ice will be deflected away from piers 2 in the same fashion as other debris.

An additional benefit is derived from the instant invention under freezing conditions. The streamwise vorticity generated will tend to control surface freezing in the area protected by the vortex generators thereby reducing the damage attendant the formation of ice on and around such structures. Thus, the vortex generators may be placed in the current of a stream at any location where it is desired to influence the formation of surface ice so as to forestall, or modify, a buildup of ice-pack. However, on the occasion of extremely low air temperatures when formation of ice solidly across the water surface cannot be prevented, the thickness of the ice at the upper extremes of the vortex radius will be less than the thickness in the areas unaffected by, or less affected by the action of the vortex. These areas of reduced thickness will respond to the stress of movement more readily than the thicker areas, thus influencing the breakup of the ice. The effectiveness of the vortex is influenced by the distance from the center of the vortex taken in a direction perpendicular to the streamwise flow. This phenomenon results in a more predictable and more controllable breakup of the surface ice.

In a similar manner the devices may be placed to divert oil slicks from littoral areas by generating a flow between a beach and an approaching oil slick paralleling the line of the beach thus retarding the depositing of the oil on the beach itself.

The devices may be employed to modify erosion patterns in littoral areas by generating a desired current, modifying an existing current or generating an interfering flow to affect an undesirable current.

If the presence of streamwise vortices downstream of a protected structure is not desirable, other vortex generators may be deployed downstream to divert or destroy the vortices after they have afforded the desired protection to the structure.

Streamwise vortices generated in a slow-moving current will enhance the oxygenation of the water by rotating lower water strata to the surface allowing a larger,volume to be exposed to the air than would be exposed by the normal current. This enhanced oxygenation of the water promotes a more robust health of the aquatic ecosystem without requiring the use of any power other than the energy of the moving water, and the absence of any machinery or moving parts results in the virtual absence of maintenance.

Another application of the device described in the patent is its employment in cooling and aeration ponds. The device, mounted on a rotating boom, will enhance the aeration and cooling of the contents of the pond with far less expenditure of energy than would be required by pumped fountain or spray.

The present invention, properly configured, should provide beneficial utility in the handling of cooling effluent from power plants taking coolant water from a body of water and returning the heated water to the same body of water. The vortices generated would increase the rate of heat exchange by exposing the heated effluent more rapidly to the surrounding water as well as to the air. The vortices will also propel the heated effluent a greater distance from the discharge point thus distributing the waste heat throughout a greater mass of water than would normally occur. In addition, the vortices would enhance the reoxygenation of the effluent which, by being used to absorb heat, has been made to give up much of its dissolved oxygen. This, again, would contribute to a more robust marine ecosystem.

Another beneficial application for the present invention is its use in aquaculture to generate desired currents for specific purposes. The devices may be configured to generate different currents at different locations in the same aquaculture site. They may also be configured to modify or divert existing currents in order to optimize flow conditions for specific crops without the necessity of constructing more costly structures which would be required to perform the same functions.

Figure 4:
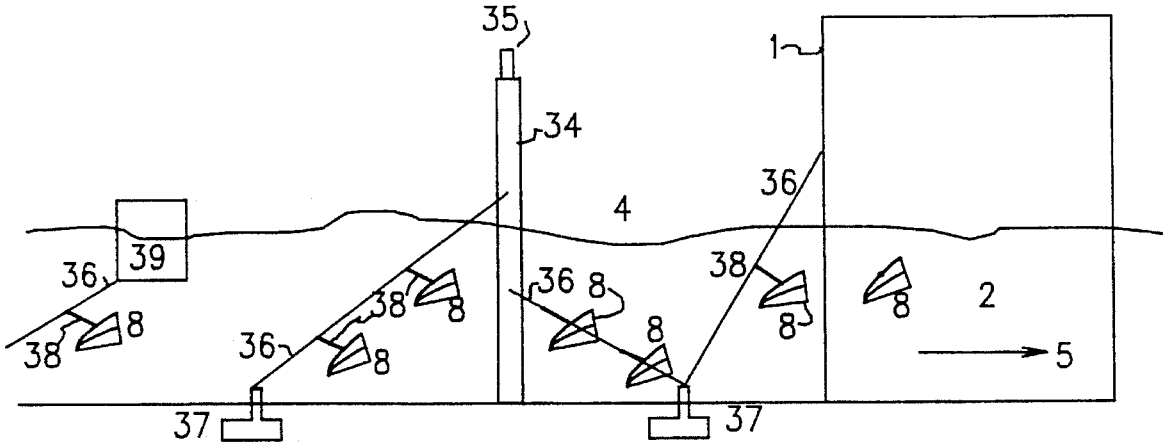
FIG. 4 is a side elevation of the bridge of FIG. 3 with alternative embodiments of the novel diverters shown diagrammatically.
Figure 5:
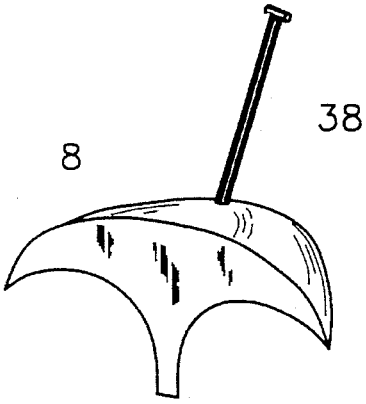
FIG. 5 is a plan view of a vortex-generating diverter shown in FIG. 4.
Figure 7:
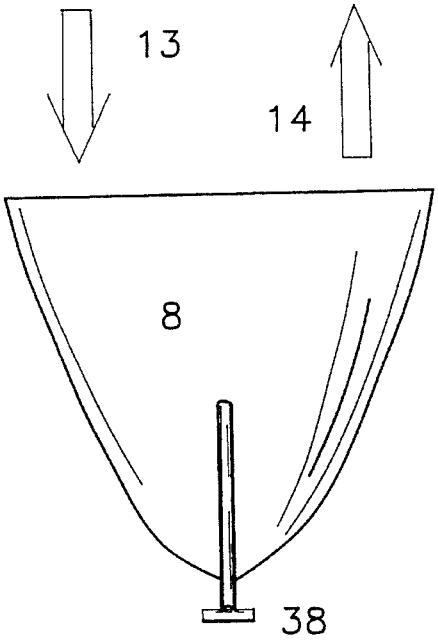
FIG. 7 is a right-side profile of FIG. 6.
Figure 6:
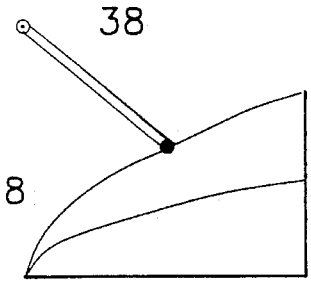
FIG. 6 is a front elevation of FIG. 5.

Alternate methods of positioning vortex generators 8 are shown in FIG. 4 which is an expanded view of FIG. 3. The generators may be fastened to the structure 2 itself or to a piling 34 driven into 3 upstream from 2 along lines 6 or 7. Piling 34 may have an aid to navigation affixed to it which would enhance safe passage for water vehicles transiting, for example, a bridge.

The vortex generators 8" with the vortex generators may be lunate (8) or hemilunate (as illustrated in FIG. 17), and may be suspended from cables 36 attached to mooring anchors 37. In FIG. 4 there are four such cases shown variously supported by piling 34 or pier 2. Although not shown, mooring cable 36 may also be supported between 34 and 2. The generators 8 are supported by linkages 38 to the cable in such a fashion that the relative flow causes the generator to operate as a lifting body thereby producing the forces required to generate the vortices. The operation of these linkages is easily understood by comparing them to the operation of an ordinary air-borne kite. In the present instance the "kite," or generator 8, is being forced downward toward the bottom 3 by the water flow instead of skyward by an airflow.

Yet another arrangement for supporting a vortex generator 8 is shown in FIG. 4 where the supporting cable 36 is suspended between an anchor 37 and a float 39. Although not shown, an array of multiple floats and pilings with attendant cables and anchors is readily apparent from the teaching associated with FIG. 4.

An especially interesting aspect of the instant invention arises when using float 39, or similar positioning system, in water subject to varying depth such as tides or flood stages. The float 39 rises and falls with the water surface 4 maintaining the attached vortex generators at a determined depth below the surface 4.

Figure 8:
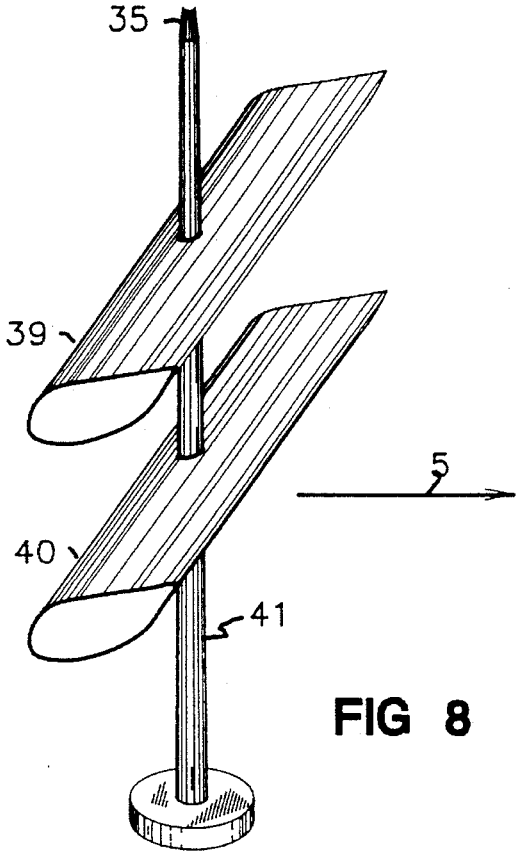
FIG. 8 is a perspective view of a bi-wing vortex-pair generator.
Figure 9:
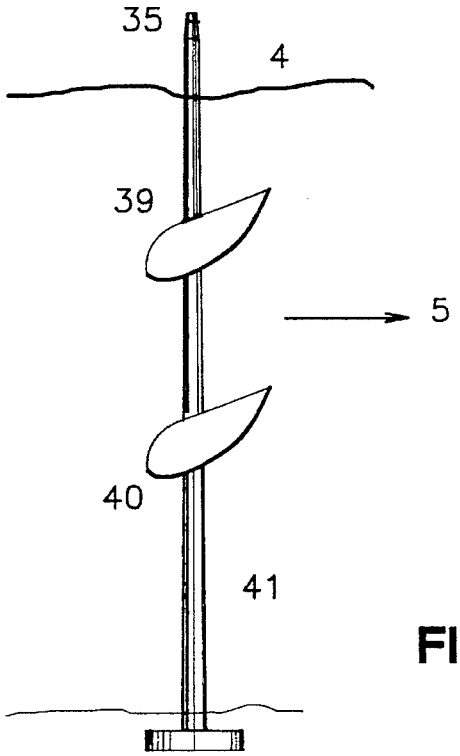
FIG. 9 is a side elevation of FIG. 8.
Figure 10:
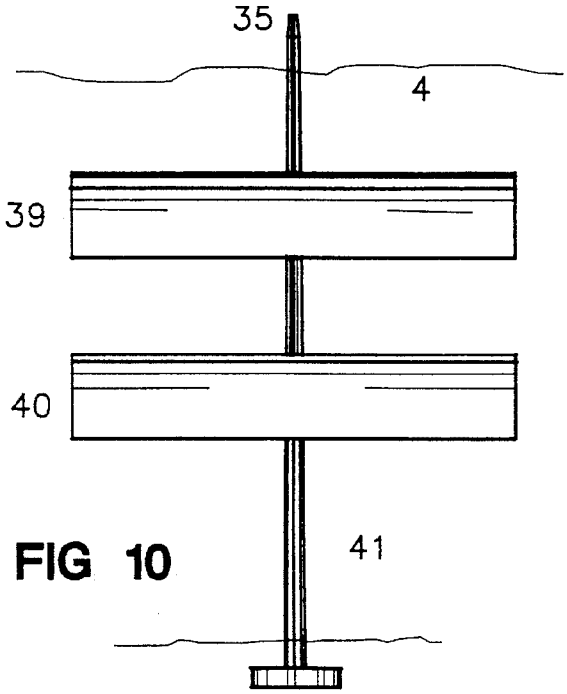
FIG. 10 is a rear elevation of FIG. 9.

Many alternative forms of vortex generators can be envisioned to accommodate various specific conditions. By analogy to an airborne kite, any lifting body in the cross-stream direction will give rise to streamwise pairs of vortices. Any of these structures could be supported from pylons anchored in the stream bed. An example is shown in FIGS. 8, 9, and 10 wherein a "biplane" structure comprised of wings 39 and 40 are supported on strut 41. In these figures the strut is shown protruding above the surface 4 to support an aid to navigation 35. The wings 39 and 40 need not be planar and, indeed, one of the wings, such as 39, could be curved to such a degree that it forms an arcuate shape surrounding all or part of the other wing 40.

Figure 11:
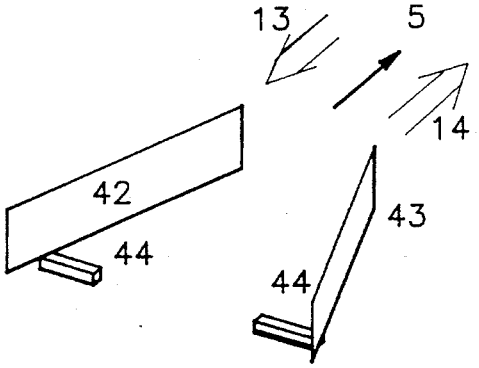
FIG. 11 is a perspective view of a vortex-pair generator formed from upright flat plates.

The lifting bodies can be disposed primarily vertically as in FIG. 11 where plates 42 and 43 are fixed to the bottom 4 by tabs 44. Plates 42 and 43 are disposed at opposite angles to line 6 so that the plate sections are located closer to the structure and line 6 as the structure 2 is approached. The water flow is thereby given an impulse in the proper direction to generate the desired vortices 13 and 14.

Figure 12:
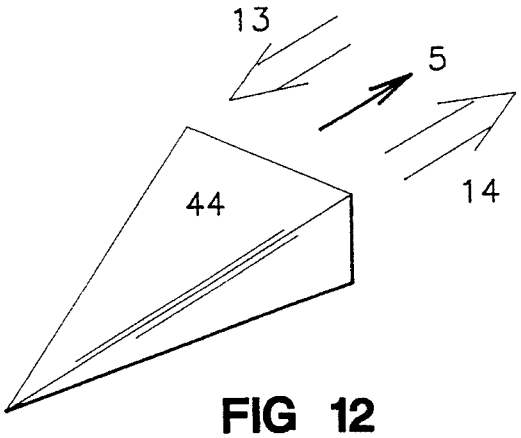
FIG. 12 is a perspective view of a vortex-pair generator wedge.

Instead of a lifting body FIG. 12 shows a simple wedge mounted on the stream bed, blocking the flow and thereby generating the desired vortices 13 and 14.

We have determined that the generator shape for optimum performance is a hemilunate lifting body. A pair of hemilunate lifting bodies may be joined to form a single lunate lifting body; a plurality of hemilunate shapes may be combined to form shapes with one or more lunate or hemilunate components.

Figure 15:
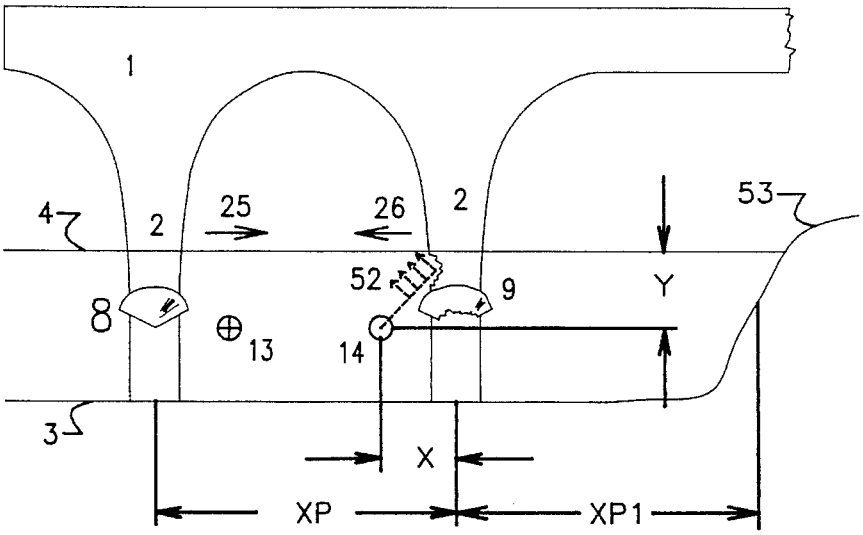
FIG. 15 is an elevation of a bridge 1 with piers 2 and river bank or similar boundary 53 viewed downstream from a point upstream from the bridge.

Referring to FIG. 15, the distance between adjacent piers or a pier and another structure of mass such as an island, river bank, glacier, or the like measured perpendicular to the streamwise direction, is denoted by X(P). The designation X(P1) is used simply to differentiate the distance between piers, X(P), from the distance between a pier and other structure or mass, at least one of which it is desired to protect. For purposes of calculation the expression X(P) may be replaced by the expression X(P1) where appropriate. The vortex cores at the bridge are 13 and 14. The core 14 is dimensioned at depth Y below the stream surface 4 and at a distance X from the bridge pier. We have determined that a preferred position of 14 is such that X=Y. The optimum value of X is X(P)/4. In instances where the optimum value of X cannot be realized, its value should be less than X(P)/4. Dimensions for 13 are derived by the fact that it is a mirror-image of 14 about the vertical plane midway between the example piers at X(P)/2.

Figure 16:
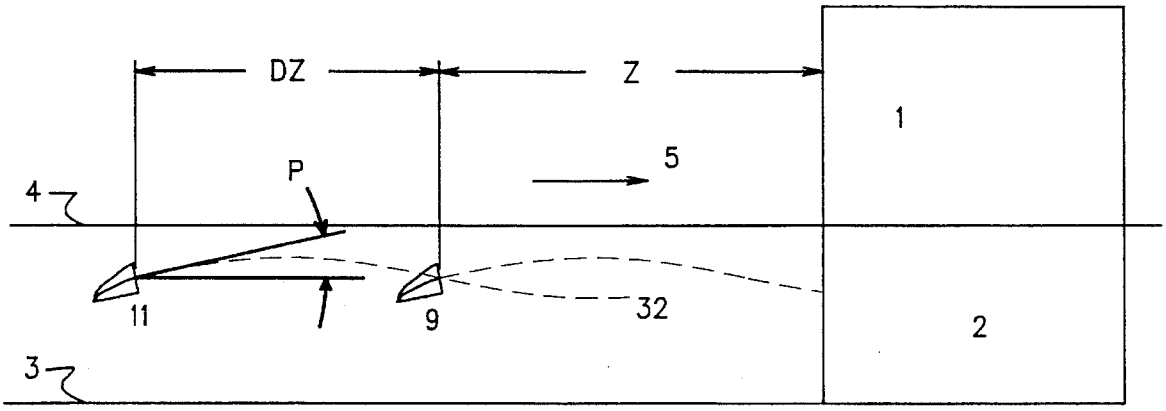
FIG. 16 is a side view of FIG. 15 viewed from but not including the river bank.

The spacing of the vortex generators such as 9 or 11 are dimensioned in FIG. 16, a side elevation of bridge 1. The generator nearest pier 2 is spaced upstream a distance Z. The next generator 11 is spaced upstream an incremental distance (Delta)Z. The pitch angle of the swirling flow P is shown schematically at 11 and is calculated as described above. A wavelength may now be defined by the relation $$Z(W)=Pi*X(P)/2*\mathrm{Cot}(P)$$

where Pi=3.14159+.

We have determined that Z should be greater than Z (W)/4. The placement of any required additional generators should be spaced upstream distances so that $$(\mathrm{Delta})Z=Z(W)/N$$

where N is an integer <=4 whose preferred value is 3 or 4.

In general the system performance improves as more generators are placed, each being spaced an incremental distance D(Z) upstream from the next downstream generator. The improvement is effected by causing the deflection of the debris to be more gradual to avoid imparting a net angular motion about a vertical axis causing the debris to be more reliably diverted between the piers. In practice, the number of generators would be limited by considerations of space, economic resources and other factors specific to a given site. However, a system employing a single pair of generators performs adequately.

Figure 13:
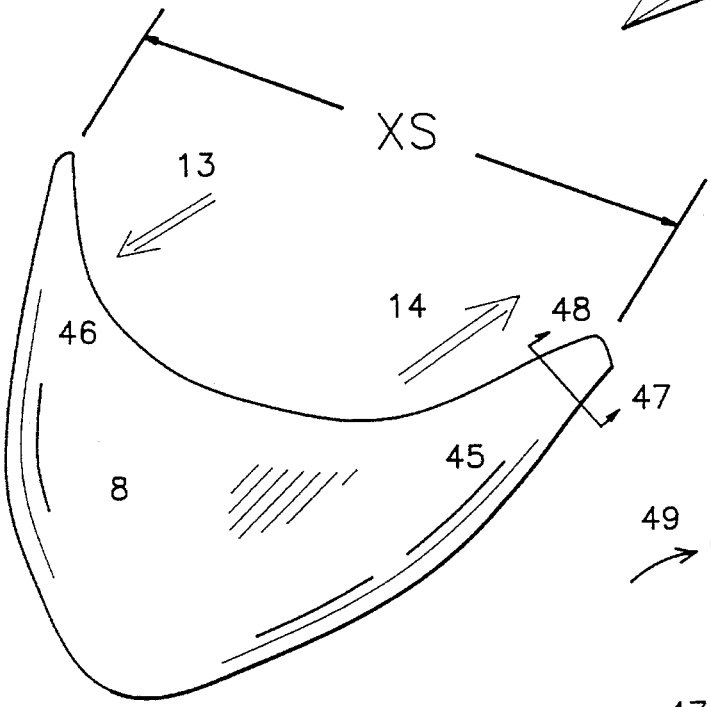
FIG. 13 is a perspective view of vortex-pair generator employing a lunate rearward portion.
Figure 14:
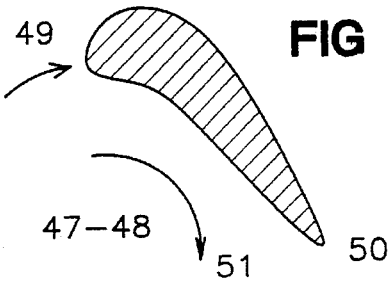
FIG. 14 is a section view of FIG. 13 taken at line 47–48.

If only one diverter is used it will generate a pair of vortices which are spaced across the stream by a distance approximately equal to the span of the diverter, X(S), as shown in FIG. 13. In this case X(S) ideally would equal (2* X). However, diverters with spans less than (2* X) work very well. In particular if N generators are used, a span, X(S), equal to 2*X/square root of N is found to be very satisfactory.

While the invention has been particularly shown and described with reference to a bridge in a stream for illustrative purposes, it will be appreciated by those skilled in the art that the present invention may be embodied in other specific forms without departing from its spirit and scope. The invention is not limited to the embodiments described herein, but may be modified within the scope of the claims.

We claim:

1. A method for protecting a structure in a stream, comprising the steps of identifying the structure to be protected, generating a streamwise vortex upstream of said structure, and generating a counter rotating stream-lee vortex upstream of said structure wherein the streamwise vortex is generated using a generator placed at a depth below the stream surface of less than or equal to approximately one-fourth of the distance between adjacent piers, other structures, or masses, at least one of which it is desired to protect.

2. A method as in claim 1, wherein a streamwise vortex is generated by placing in said stream a device for directing the flow of buoyant contaminants so as to reduce impact with downstream structures, said device comprising one or more streamwise vortex generators and said device being placed sufficiently close to the surface of said stream to generate a streamwise vortex which affects the flow of buoyant contaminants.

3. A method as in claim 1, wherein a streamwise vortex is generated by placing in said stream a device for directing the flow of buoyant contaminants so as to reduce impact with downstream structures, said device comprising a plurality of streamwise-vortex generators aligned substantially along the flow of said stream so that the streamwise vortices generated by each device in the alignment reinforce each other.

4. A method as in claim 1, wherein a streamwiee vortex is generated by placing in said stream a device for directing the flow of buoyant contaminants so as to reduce impact with downstream structures, said device comprising one or more streamwise-vortex generators wherein said device is placed so as to induce a vortex in the current flow whose axis is essentially parallel to the streamwise flow, and which affects the flow of said buoyant contaminants.

5. A method as in claim 1, wherein a streamwise vortex is generated by placing in said stream a device for directing the flow of buoyant contaminants so as to reduce impact with downstream structures, said device comprising a plurality of streamwise-vortex generators, aligned so that the streamwise vortices generated by each generator in the alignment reinforce each other.

6. A method as in claim 1, wherein a streamwise vortex is generated by placing in said stream a device for directing the flow or buoyant contaminants so as to reduce impact with downstream structures, said device comprising a plurality of streamwise-vortex generators offset from each other with respect to the stream flow.

7. A method as in claim 1 wherein said generator is of arcuate lifting shape.

* * * * *